US005953880A

United States Patent [19]

De Zen

[11] Patent Number: 5,953,880

[45] **Date of Patent: *Sep. 21, 1999**

[54] FIRE RATED MODULAR BUILDING SYSTEM

[75] Inventor: Vittorio De Zen, Woodbridge, Canada

[73] Assignee: Royal Building Systems (CDN) Limited, Woodbridge, Canada

[ * ] Notice: This patent is subject to a terminal disclaimer.

[21] Appl. No.: 08/817,958

[22] PCT Filed: Oct. 20, 1995

[86] PCT No.: PCT/CA95/00592

§ 371 Date: May 1, 1997

§ 102(e) Date: May 1, 1997

[87] PCT Pub. No.: WO96/14480

PCT Pub. Date: May 17, 1996

[30] Foreign Application Priority Data

Nov. 2, 1994 [CA] Canada ..... 2134959

[51] Int. Cl.[6] ..... E04C 3/30

[52] U.S. Cl. ..... 52/737.6; 52/738.1

[58] Field of Search ..... 52/91.2, 91.3, 52/284, 270, 433, 439, 737.6, 738.1

[56] References Cited

U.S. PATENT DOCUMENTS

| | | |
|---|---|---|
| 2,131,115 | 9/1938 | Naisuler . |
| 3,196,499 | 7/1965 | Houvener . |
| 3,712,004 | 1/1973 | Loebsack . |
| 3,957,723 | 5/1976 | Lawson et al. . |
| 3,992,839 | 11/1976 | Borde . |
| 4,147,690 | 4/1979 | Rich . |
| 4,536,360 | 8/1985 | Rahrig . |
| 4,557,091 | 12/1985 | Auer . |
| 5,216,863 | 6/1993 | Nessa et al. . |
| 5,706,620 | 1/1998 | De Zen . |
| 5,729,944 | 3/1998 | De Zen . |

FOREIGN PATENT DOCUMENTS

| | | |
|---|---|---|
| 1102938 | 6/1981 | Canada . |
| 2070079 | 11/1993 | Canada . |
| 2097226 | 11/1994 | Canada . |
| 0215652 | 3/1987 | European Pat. Off. . |
| 0320745 | 6/1989 | European Pat. Off. . |
| 1517668 | 10/1978 | United Kingdom . |
| 94/21867 | 9/1994 | WIPO . |

*Primary Examiner*—Carl D. Friedman
*Assistant Examiner*—Dennis L. Dorsey

[57] ABSTRACT

Extruded hollow thermoplastic structural components of rectilinear cross section formed for interlocking assembly with mating components for use in erecting a modular building characterized in that said components are extruded from PVC material which includes a smoke retarding agent which is covered by a skin (3) on surfaces exposed to the environment. Preferably the component is an elongated extruded hollow thermoplastic structural component of rectilinear cross section formed for interlocking assembly with mating components for use in erecting a modular building, characterized in that said component is formed as a co-extrusion of a substrate (2) of PVC containing from about 10% et 35% by weight of the substrate of a reinforcing and expansion controlling agent and from about 5% to about 35% per weight of the substrate (2) of smoke retarding agent, the total of said agents being less than about 45% by weight of the substrate, and a thermoplastic skin (3) covering surfaces of said component which remain exposed when said component is interlocked with mating components in a building structure, said substrate (2) being substantially thicker than said skin (3), said skin (3) forming a protective barrier to isolate said smoke retarding agent from exposure to the environment exterior of said component when same is incorporated into a building structure.

19 Claims, 5 Drawing Sheets

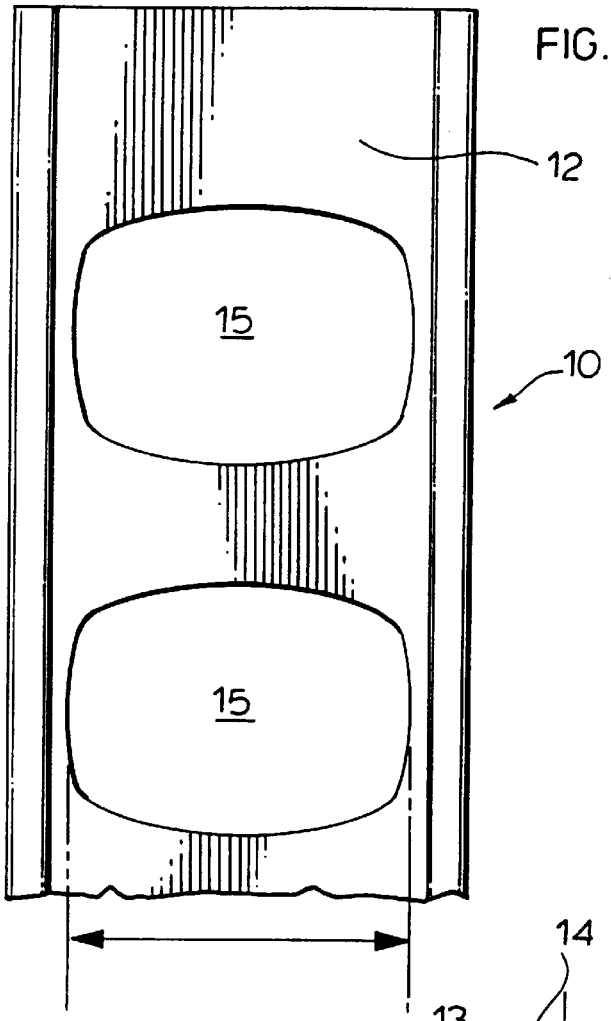
FIG. 3.
FIG. 4.
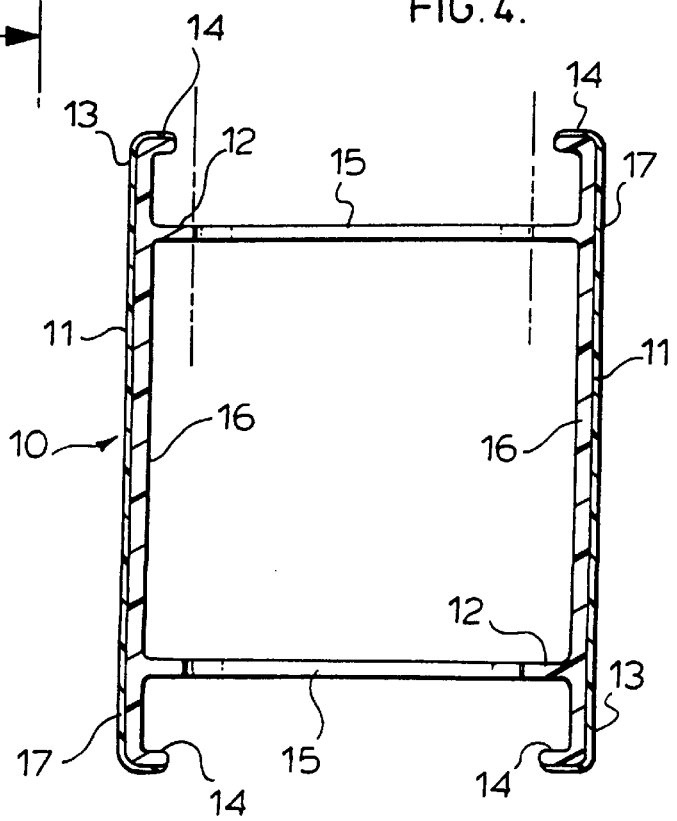

FIRE RATED MODULAR BUILDING SYSTEM

FIELD OF THE INVENTION

This invention relates to modular building systems of the type disclosed in my Canadian Applications Serial No. 2,070,079 filed May 29, 1992 and Serial No. 2,097,226 filed May 28, 1993 and Serial No. 2,124,492 filed May 27, 1994, whereby houses or other building structures can be easily and quickly erected using prefabricated extruded thermoplastic interlocking structural components.

As disclosed in my earlier applications, I have provided elongated extruded thermoplastic components including hollow rectilinear wall and roof panels, box connectors and the like formed for interlocking assembly for use in creating a modular building on a support base, such extrusions being a coextrusion of a substrate and a thin skin to provide protection against weathering, ultraviolet rays and the like, provide impact resistance, and present an aesthetic appearance for the exposed building surfaces. Such substrate material particularly described comprises a polyvinyl chloride (PVC) with a reinforcing or stiffening and expansion controlling agent which includes, inter alia, calcium carbonate or fibrous material such as fine mineral or glass fibers. The skin of such components may comprise PVC, rigid PVC, non-rigid PVC, ABS, polycarbonates with suitable material being available from G.E. under the trade-marks GELOY and NORYL. The said protective skin may include, inter alia, agents that provide impact resistance as well as protection against ultra violet radiation and weathering and may also include colouring agents.

While the structural components of my earlier applications provided for the erection of permanent buildings capable of withstanding the effects of sun, high and low temperatures, high winds, rain and snowstorms and earth tremors, in jurisdictions which set stringent smoke and fire rating requirements, it has been a problem to meet such requirements while holding down the cost of the structural components.

The present invention is directed to provide such aforesaid thermoplastic structural components which will meet such fire rating requirements while maintaining the low cost of their production.

PRIOR ART

Prior to my aforesaid developments, none of the prior art provided an acceptable or practical thermoplastic structures for permanent low cost housing. For example, EP-A-O 320745 discloses an arrangement of hollow interlocking structural components for a modular building which are formed entirely of a thermoplastic resin preferably reinforced with about 30% by weight glass fibers such as described in U.S. Pat. No. 4,536,630. Not only is it a problem to extrude such proposed components, they are unsuitable for practical housing as they are rough, abrasive, brittle and are subject to fracture and weather deterioration and would not meet normal building code requirements including building code requirements against smoke and fire hazards.

U.S. Pat. No. 3,992,839, for instance, discloses a plastic panel fabricated from separate panel members preferably formed of polyvinyl chloride which snap together to form a thin wall panel. The panels in turn are formed to snap together to provide a wall structure. Such fabricated panels are not only inherently weak and lack the strength and load bearing capacity to form adequate structural components but would not provide adequate smoke and fire properties.

U.S. Pat. No. 4,557,091 discloses a hollow panel member having a width of about one and one-half inches (1 and ½") and a complicated interior formed by protrusion, a process involving drawing long glass strands and a plastic binding material forcibly through a dye under heat to form the glass strands into a compacted glass mat bound together by the plastic material. Such a process is prohibitively slow and expensive and the panels themselves do not have adequate smoke and fire retarding properties and do not provide acceptable or practical structures for forming the walls and roofing of a housing system.

SUMMARY OF THE INVENTION

According to the present invention, I have found that by making use of the provision of the thin coextruded protective skin on the peripheral surfaces of my aforesaid structural components which are exposed after they have been assembled with mating components, I can provide the requisite smoke and fire retarding characteristics to meet the building code requirements by incorporating suitable effective smoke, and hence fire hazard, retarding agents in the underlying PVC substrate material where such agents are isolated from weathering by the protective skin. Since the skin of the components represents only a small volume of the total material, the fact that effective smoke/fire retarding agents which exhibit poor weathering qualities can be kept out of the skin does not adversely effect the components overall smoke and fire rating characteristics. Thus the invention has enabled the provision of thermoplastic building components which will maintain their acceptable fire ratings indefinitely.

It has been found that with the incorporation of the smoke retarding agent in the substrate, calcium carbonate can be used in conjunction therewith as a suitable reinforcing or stiffening and expansion controlling agent or constituent in the PVC as an effective cost control.

Suitable smoke retarding agents for incorporating into the substrate according to the invention may be selected for example from one or more of aluminum trihydrate, zinc borate, antimony trioxide, antimony oxide or magnesium hydroxide. Depending on the building code requirements in the jurisdictions in which the building structures are to be erected, the substrate may incorporate from about 5% to about 35% by weight of such selected retarding agent or agents. With calcium carbonate used as the reinforcing or stiffening agent and expansion controlling agent, the amount of calcium carbonate which may be incorporated in the PVC substrate would be from about 10 to about 35% and preferably from about 20% to 25% by weight of the substrate material. The total of smoke retarding agent or agents and reinforcing and expansion controlling agents (eg. calcium carbonate) should not exceed 45% and preferably should not exceed 35% to 40% by weight.

BRIEF DESCRIPTION OF THE DRAWINGS

The invention will be more fully understood from the detailed description taken in conjunction with the accompanying drawings in which

FIG. 3 is a broken away elevational view looking edge wise of a typical fire rated box connector for connecting adjoining panels such as illustrated in FIGS. 1 and 2;

FIG. 4 is a horizontal cross section of the box connector of FIG. 3;

DETAILED DESCRIPTION OF THE PREFERRED EMBODIMENTS

Figure 1:
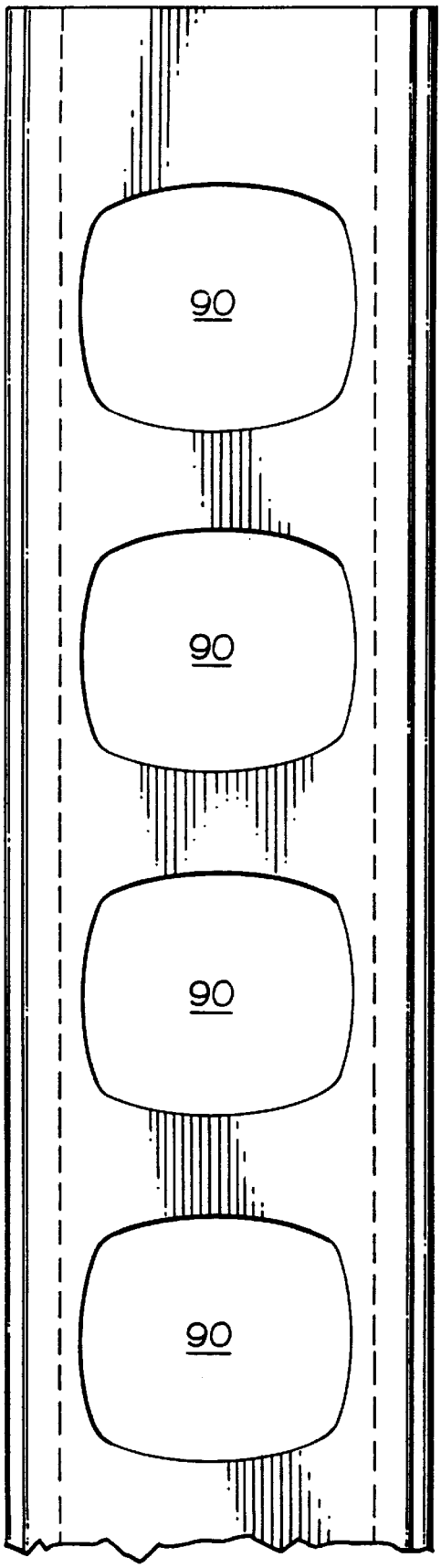
FIG. 1 is a broken away elevational view looking edge wise of a typical fire rated wall panel according to the invention.

While polyvinyl chloride (PVC) is not itself readily flammable and does not rapidly propagate a fire, it does create a very significant or excessive amount of smoke when ignited and this smoke creates a serious hazard to persons trying to locate exits to escape the fire. In many jurisdictions, the use of PVC building components which give rise to smoke problems are considered fire hazards and are precluded from use under stringent building code regulations.

While incorporation of inorganic materials into the PVC to provide stiffening or reinforcing and expansion controlling characteristics may reduce to some extent the smoke generated on ignition of the composite material, there is a limit to the amount of such material that can be introduced and still have a component that can be extruded, is structurally sound, will weather well, and will not be subject to fracture under use and handling. As a result, the use of such reinforcing materials do not provide the requisite level of smoke reduction to meet the stringent fire rating restrictions of many jurisdictions.

While smoke retarding agents which reduce fire hazards are known, it has been found that they exhibit poor weathering qualities so that their use in PVC components which are intended as structural members exposed to the environment is to be avoided.

According to the present invention, through the provision of the isolating skin covering the surfaces of the components which are exposed when the components are interlockingly assembled into a building structure, the properties of these smoke retarding agents can be utilized by incorporating them into the substrate.

It has been found that components extruded from PVC which incorporate a smoke retarding agent and a reinforcing and expansion controlling agent in the substrate and a protective skin free of smoke retarding agents will provide components which meet the requisite fire rating properties of jurisdictions have stringent fire rating building codes.

It will be understood that the fire rating characteristics of the components will increase with an increase in the quantity of the smoke inhibiting agents and the strengthening or stiffening of the components will decrease with a decrease in the quantity of the strengthening of stiffening agent. As a practical matter, it has been found that the total of the smoke retarding agent or agents and the reinforcing or stiffening agent or agents should not exceed about 45% and preferably not more that about 35% to 40% by weight of the PVC in the substrate.

Depending upon building code requirements and bearing in mind the maximum concentration of the smoke inhibiting and stiffening agents, the smoke inhibiting agent may comprise from about 5% to 35% by weight of the substrate material and the reinforcing or stiffening and expansion controlling agent or agents may comprise from about 10% to 35% by weight and preferably 20% to 25% by weight of the substrate material.

Although other reinforcing and stiffening agents such as fine mineral or glass fibers could be used, calcium carbonate provides an inexpensive and practical stiffening agent for use in association with the smoke retarding agent or agents.

In this connection as hereinafter set out, the hollow structural components comprising the wall panels and their box connectors of the invention are adapted to be filled with concrete which may be suitably reinforced with rebar, these components when erected and filled with concrete present structurally solid walls so that the percent of the stiffening and expansion controlling agent need only be sufficient to preserve their configuration under pouring of the concrete therein so that the percentage of smoke retarding agent or agents can be increased to meet the more stringent fire rating regulations and the contained concrete adds to their resistance to fire and collapse while the smoke retarding agent or agents minimizes the smoke given off.

In the same vein, while the hollow roof panels and connectors are not intended to be filled with concrete, it has been found that their resistance to fire and collapse can be effectively controlled by introducing metal inserts, eg. of aluminium, or steel sleeved therein while the incorporated smoke retarding agent minimizes the smoke given off. In addition, the presence of these metal inserts reduces the amount of reinforcing or stiffening and expansion controlling agent required in the roof members while providing for large roof loadings and at the same time allows for an increase in the smoke retarding agent or agents in the substrate.

Figure 2:
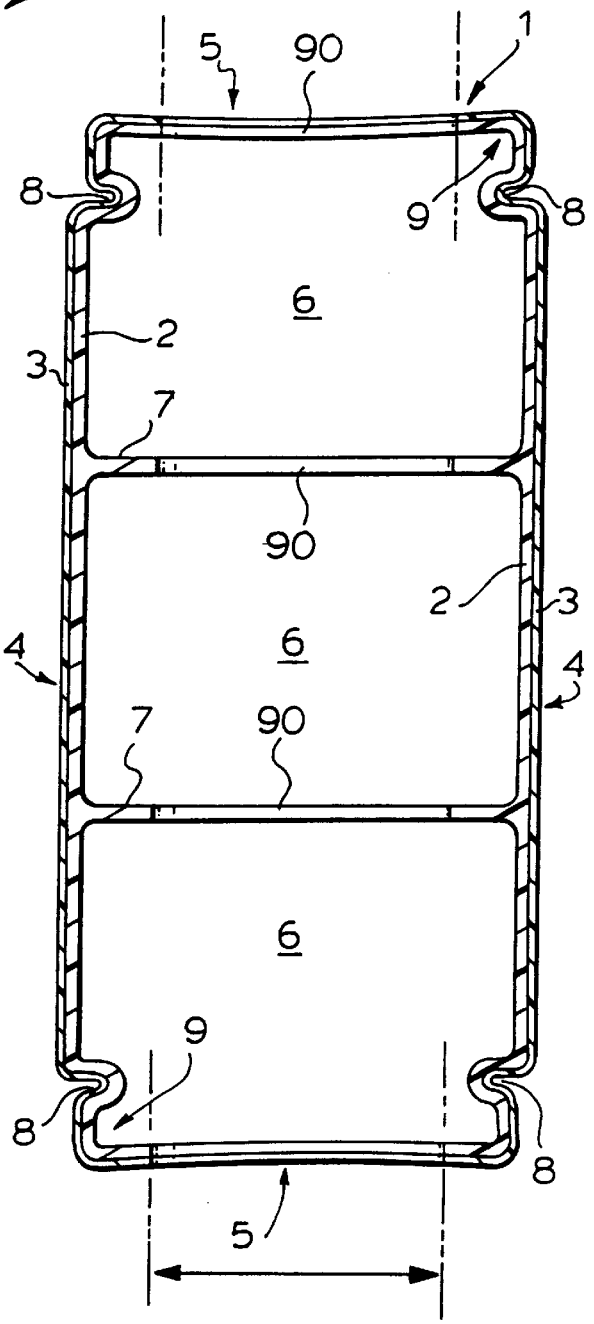
FIG. 2 is a horizontal cross section of the wall panel of FIG. 1.

Referring to FIGS. 1 and 2, the wall panel 1 shown therein comprises a co-extrusion of a substrate 2 and an overlying thin skin 3. The length or height of the panel would be the height of the wall of the building structure to be erected therefrom. A practical panel width between the panel faces 4 which become the walls of the building structure when the panel is assembled may be chosen at 100 millimeters. The width of the panels themselves between the edges 5 is chosen so that when they are assembled in interlocking relationship with connecting box connectors the distance between center lines of such connected panels would be ⅓rd of a meter to provide a convenient modular base dimension As illustrated in FIG. 2, the panel 1 is divided into three compartments 6 by webs 7.

Adjacent each of edge walls 5 the panel is formed at the opposite faces thereof with registering inturned locking grooves 8 and the width of the panel in the direction between the faces 4 is slightly reduced so that in effect the panel portion indicated at 9 between the grooves 8 and edge walls 5 become locking tongues.

Preferably the edge walls 5 are slightly concave to facilitate there interlocking assembly with connecting box connectors.

The wall panel 1 is preferably cored to provide a predetermined pattern of openings 90 extending through the edge walls 5 and webs 7.

As an example, the substrate 2 for a panel of the dimensions discussed above may have a thickness of the order of about 2.5 to 3 millimeters in the peripheral walls of the panel and from about 1.5 to 2 millimeters in the webs 7.

This substrate 2 is comprised of a polyvinyl chloride and the reinforcing or stiffening and expansion controlling agent and a smoke retarding agent.

Depending upon the building codes, the smoke retarding agent may be incorporated in an amount from about 5% to about 35% by weight of the substrate composition and the reinforcing or stiffening and expansion controlling agent or constituent may be incorporated into the PVC substrate in an amount from about 10% to 35% by weight. With the maximum combined total of said agents not to exceed 45% and preferably not to exceed 35% to 40% by weight of the substrate.

Where the fire rating regulations are not too onerous, the PVC substrate desirably may contain from about 20% to 25% by weight of the reinforcing or stiffening and expansion controlling agent and from about 10% to about 20% by weight of the smoke retarding agent to bring the combined total of these agents in the range of from about 30% to 40% by weight of the substrate.

While a number of reinforcing or stiffening and expansion controlling agents may be employed such as mineral or glass fibers, calcium carbonate can advantageously be used in conjunction with the smoke retarding agent for cost savings in the component per se and to facilitate the extrusion process in the forming of the components.

Suitable smoke retarding agents which reduce the hazards of a fire that may be used are aluminum trihydrate, zinc borate, antimony trioxide, antimony oxide, or magnesium hydroxide.

The skin or cap stock 3 has a thickness substantially less than the thickness of the substrate and may have a thickness of about 0.35 to 0.45 millimeters. The skin 3 may comprise PVC, rigid PVC, non-rigid PVC, ABS polycarbonates with suitable material being available from G.E. under the trademarks GELOY and NORYL. This protective skin as will be understood by those skilled in the art may include, inter alia, suitable agents which provide impact resistance as well as protection against ultraviolet radiation and weathering and may also include colouring agents.

FIGS. 3 and 4 illustrate a fire rated box connector 10 according to the invention.

Box connector 10 has spaced parallel walls 11 connected by webs 12 which define a square which in the system described is 100 millimeters by 100 millimeters.

The walls 11 extend outwardly beyond the webs 12 to define flanges 13 which terminate in inturned oppositely registering locking fingers 14. The webs 12 are cored to provide a predetermined pattern of openings or holes 15 corresponding to the openings or holes 90 of the panel 1.

The walls 11 including the flanges 13 and preferably the outer surfaces of the locking fingers 14 are comprised of a substrate 16 corresponding to the substrate 2 of the wall panel 1 and a co-extruded skin or cap stock 17 corresponding to the skin 3 of the wall panel 1.

It will be appreciated that in the case of both the wall panel 1 and the box connector 10 the volume of the skin material will be only a small proportion which may be of the order of about 10% or less of the volume of the substrate material which contains the reinforcing or stiffening and expansion controlling agent or agents and the smoke retarding agent or agents as discussed above.

Figure 5:
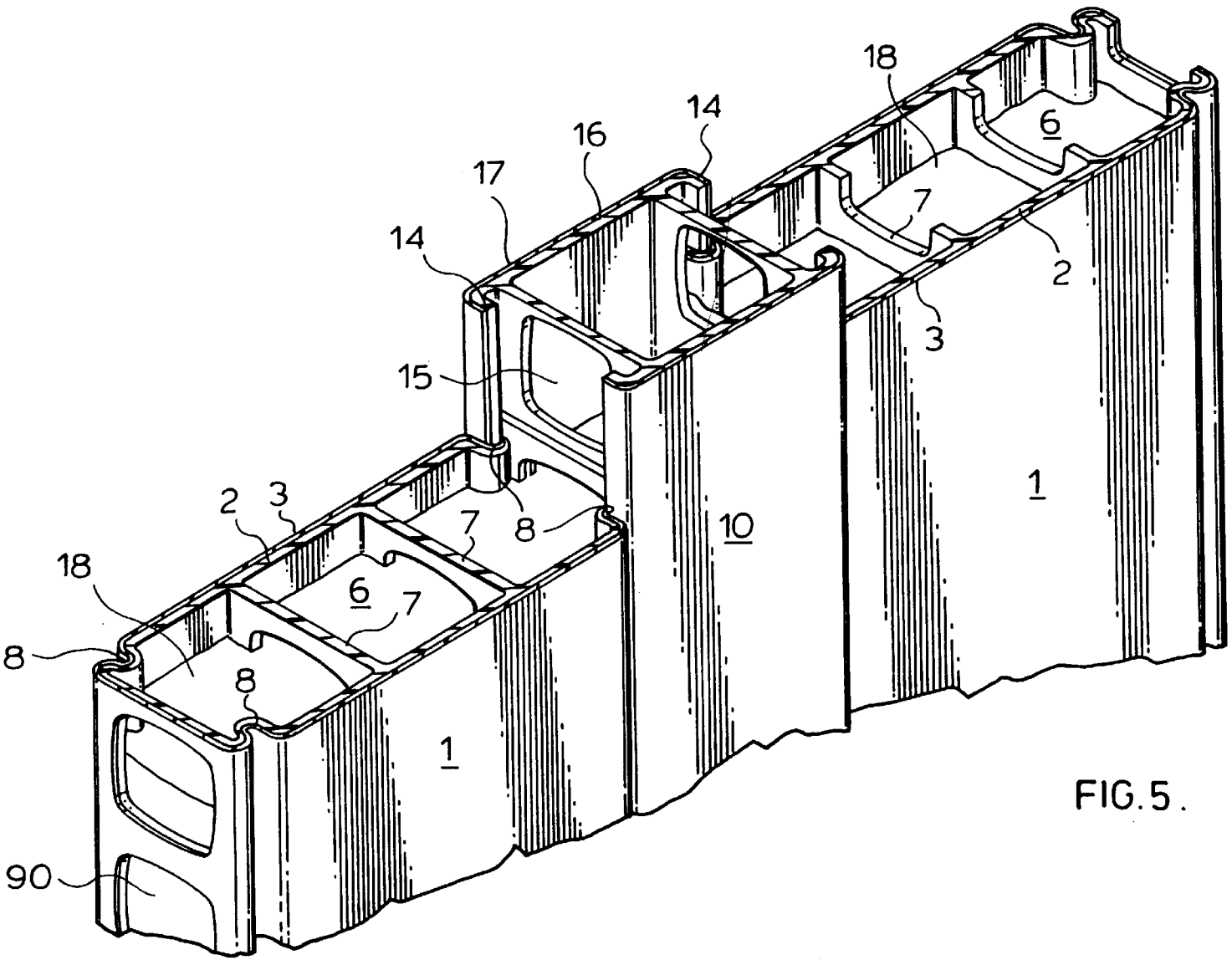
FIG. 5 is a part sectional part perspective view showing the manner in which the box connector of FIGS. 3 and 4 interlocks with the wall panels of FIGS. 1 and 2.

FIG. 5 illustrates how a wall is formed by interlocking wall panels 1 by means of the box connector 10 in which the fingers 14 of the box connector engage in the grooves 8 of the panels with the tongue portions of the panels anchored behind the box connector fingers.

As illustrated, when the panels have been assembled into a wall formation with the interlocking box connectors, they are adapted to be filled with concrete 18 and the openings 90 of the panels and 15 of the box connectors are adapted to register to provide through flow passages for the flow of the concrete which gives the permanent rigidity to the walls and permanently interlocks the components together.

Reinforcing rods or rebar (not shown) may be inserted through the registering or openings 90 and 15 for added strength if desired.

As will be appreciated from FIG. 5, the exposed surfaces of the interlocked panels and box connector all are covered with their smooth skins which not only provide protection but give a clean aesthetic appearance thereto hiding or masking any blemishes in the substrate. As a result, an added cost saving can be obtained by using reground or reprocessed PVC material in the substrate.

In this connection, the material cut out from the panels to produce the pattern of holes 90 therein and the material cut out from the box connectors to produce the pattern of holes 15 therein forms an important course of feed stock for the substrate material of subsequently extruded components of the invention so that wastage is eliminated and costs are reduced.

Figure 6:
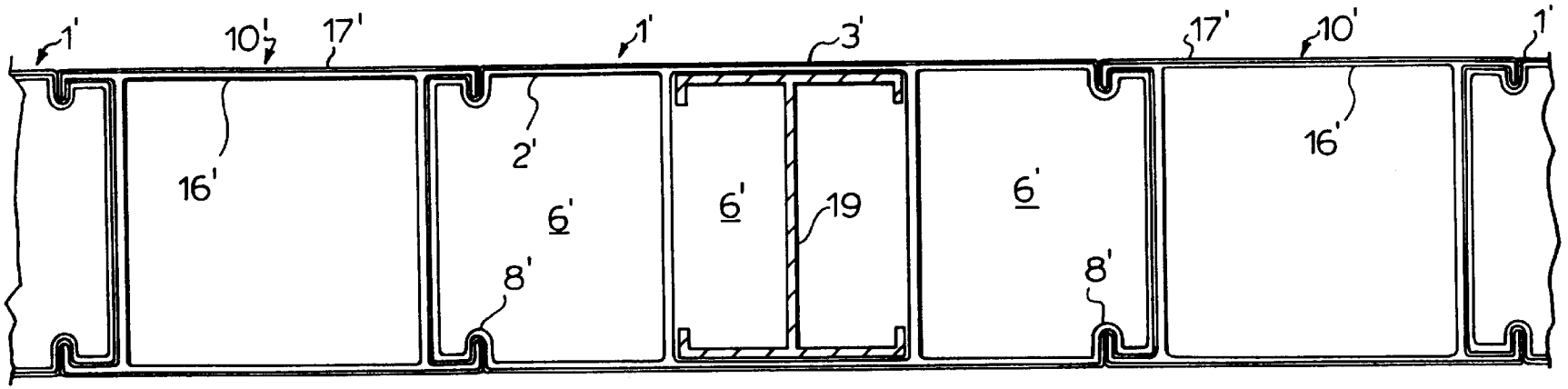
FIG. 6 is a broken away end elevational view of a roof section in which fire rated roof panels are interlockingly connected by fire rated box connectors according to the invention and showing the use of a metal insert sleeved within one of the compartments of the roof panel.

With reference to FIG. 6, there is shown a portion of a roof structure formed with interlocking roof panels 1' and box connectors 10'. The roof panels 1' correspond to the wall panels 1 with the exception that they are not cored. Similarly the box connectors 10' correspond to the box connectors 10 but also are not cored.

The substrates 2' and 16' of the panels 1' and box connectors 10' correspond to the substrates 1 and 16 of the wall panel 1 and box connector 10 respectively. Similarly the skin 3' of the roof panel 1' corresponds to the skin 3 of the wall panel 1 and the skin 17' of the box connector 10' corresponds to the skin 17 of the box connector 10.

To provide reinforcement in the roof structure as illustrated in FIG. 6 a metal I-beam 19 is sleeved within the central compartment 6' of the roof panel 1'.

The I-beam 19 which will extend substantially the full length of the roof panel 1 is preferably formed of a aluminium although a steel beam could be used.

Figure 7:
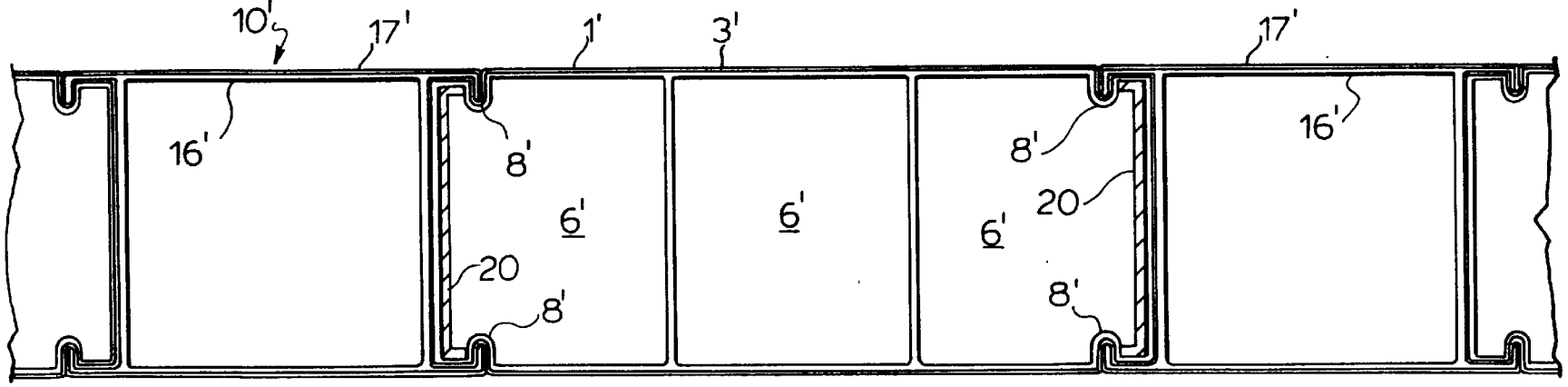
FIG. 7 is a view similar to FIG. 6 but showing an alternative arrangement of metal stiffeners sleeved with the roof panel.

FIG. 7 is a view similar to FIG. 6 but illustrates the use of shallow metal channel stiffeners 20 fitted into the tongue portions of the roof panels 1' behind the locking grooves 8'.

These stiffeners 20 are preferably formed of steel although aluminium could be used and they would run substantially the length of the panel 1'.

Figure 8:
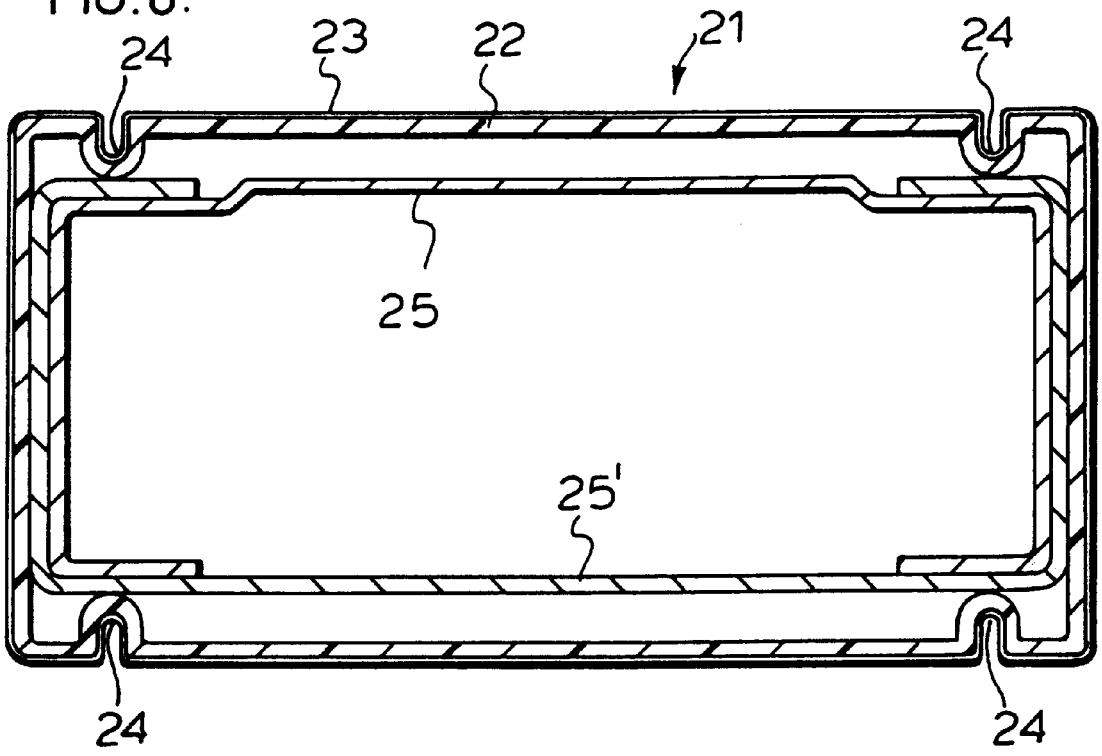
FIG. 8 is an end elevational view of a fire rated roof beam having a metal box beam structure sleeved therewithin.

FIG. 8 is an end view of a roof box beam 21 extruded from PVC containing reinforcing or stiffening and smoke retarding agents as aforesaid. The beam is illustrates as having a substrate 22 corresponding to the substrate material 2 of the wall panel 1 and a skin 23 corresponding to the skin 3 of the wall panel 1. This beam 21 is provided with inturned locking grooves 24 to receive mating fingers of other locking components not shown. The beam is reinforced by having sleeved therein metal members 25 and 25' which form a box beam within the box beam 21. These members 25 and 25' are preferably hot-dipped galvanized sheet steel although an aluminium box beam could be used.

Where the beam 21 is not exposed to either the weather or viewing, the skin 23 may be omitted.

Figure 9:
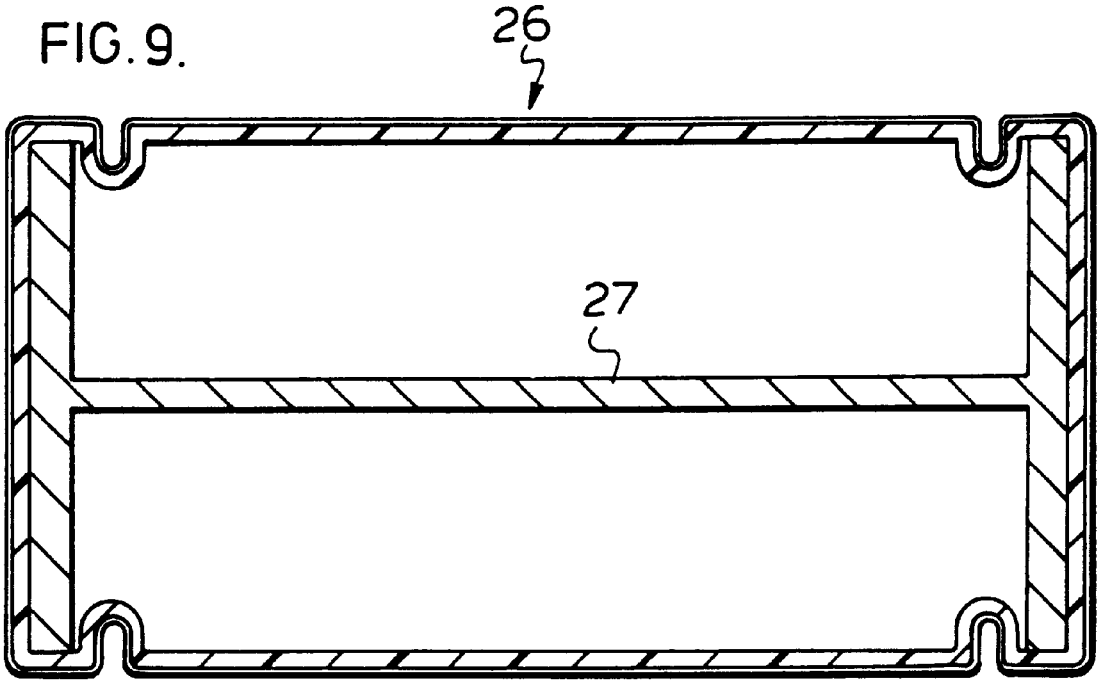
FIG. 9 is a view similar to FIG. 8 but in cross section showing a metal I-beam sleeved within the roof beam.

FIG. 9 is a box beam 26 corresponding to the box beam 21 but having an I-beam 27 sleeved therein which preferably is of steel but may be of aluminium.

While specific embodiments of the invention have been described, it will be understood that variations may be made therein as will be apparent to those skilled in the art without departing from the scope of the appended claims.

The embodiments of the invention in which an exclusive property or privilege is claimed are defined as follows:

1. An elongated extruded hollow thermoplastic structural component of rectilinear cross-section formed as a co-extrusion of a substrate and a thermoplastic skin covering surfaces of said component which remain exposed when said component is interlocked with mating components in the building structure, said substrate being substantially thicker than said skin characterized in that said substrate comprises PVC containing a reinforcing and expansion controlling agent in an amount from about 10% to about 35% by weight of the substrate and a smoke and fire retarding agent in an amount from about 5% to about 35% by weight of said substrate, the total of said agents being less than about 45% of the substrate, and said skin is free of any smoke and fire retarding agent and forms a protective barrier to isolate said smoke and fire retarding agent from exposure to the environment exterior of said component when same is incorporated into a building structure.

2. A structural component as claimed in claim 1 in which said reinforcing and expansion controlling agent is present in the amount of about 20% to 25% by weight and said fire retarding agent is present in an amount of about 5% to about 20% by weight of said substrate and the total of said agents being less than about 40% by weight of said substrate.

3. A structural component as claimed in claim 1 characterized in that said smoke retarding agent is selected from one or more of aluminum trihydrate, zinc borate, antimony trioxide, antimony oxide or magnesium hydroxide.

4. A structural component as claimed in claim 1 characterized in that said reinforcing and expansion controlling agent is present in an amount from about 10% to 15% by weight of said substrate.

5. A structural component as claimed in claim 1 characterized in that said reinforcing and expansion controlling agent is selected from one or more of calcium carbonate or fine mineral, cellulose or glass fibers.

6. A structural component as claimed in claim 1 characterized in that said reinforcing and expansion controlling agent is calcium carbonate.

7. A structural component as claimed in claim 1 characterized in that said reinforcing agent is calcium carbonate and said smoke retarding agent is selected from one or more of aluminium trihydrate, zinc borate, antimony trioxide, antimony oxide or magnesium oxide.

8. A structural component as claimed in claim 7 characterized in that said thin skin comprises a polyvinyl chloride containing an ultraviolet radiation protective agent.

9. An elongated extruded hollow thermoplastic structural component of rectilinear cross-section formed as a co-extrusion of a substrate materials and a thermoplastic skin covering surfaces of said component which remain exposed when said component is interlocked with mating components in the building structure, said substrate being substantially thicker than said skin, characterized in that said substrate material comprises PVC containing a reinforcing and expansion controlling agent and a smoke in an amount from about 10% to about 35% by weight of said substrate and fire retarding in an amount from about 5% to about 35% by weight of said substrate, the total of said agents being less than about 45% of said substrate agent with at least some of said substrate material being reprocessed material and said skin is free of any smoke and fire retarding agent and forms a protective barrier to isolate said smoke and fire retarding agent from exposure to the environment exterior of said component when same is incorporated into a building structure.

10. A structural component as claimed in claim 9 characterized in that said component is cored to provide a predetermined pattern of spaced holes along the length of the walls thereof which become internal walls when same is interlockingly assembled with mating components.

11. A structural component as claimed in claim 10 characterized in that said predetermined spaced pattern of holes being such that the holes of mating components are in registration to provide internal flow passages therebetween.

12. A structural component as claimed in claim 10 characterized in that the substrate of said component includes reprocessed corings of previously cored structural components.

13. A structural component as claimed in claims 1 or 9 characterized in that said component comprises a panel having a plurality of internal compartments running the length thereof and at least one reinforcing metal insert sleeved within at least one of said hollow compartments and spanning between the walls thereof subject to deflection under loading.

14. A structural component as claimed in claim 13 in which said reinforcing metal insert is an I-beam selected from aluminum or steel.

15. A structural component as claimed in claim 13 in which a plurality of inserts are sleeved within a plurality of aid internal compartments.

16. A structural component as claimed in claim 15 in which said plurality of inserts comprise shallow channels selected from aluminum or steel.

17. A structural component as claimed in claims 1, 3 or 9 characterized in that it comprises an elongated hollow box beam having a metal reinforcement structure sleeved within said beam and spanning between the walls thereof subject to deflection under loading.

18. A structural member as claimed in claim 17 characterized in that said metal reinforcement structure comprises steel members forming a box beam within said thermoplastic box beam.

19. A structural member as claimed in claim 17 in which said metal reinforcement structure comprises an I-beam of steel or aluminium.

* * * * *